US005374049A

United States Patent [19]

Bares et al.

[11] Patent Number: 5,374,049

[45] Date of Patent: Dec. 20, 1994

[54] COMPACT INVERTER

[75] Inventors: Jan Bares, Webster; Thomas Acquaviva, Penfield, both of N.Y.

[73] Assignee: Xerox Corporation, Stamford, Conn.

[21] Appl. No.: 250,215

[22] Filed: May 27, 1994

[51] Int. Cl.[5] ..... B65H 29/00

[52] U.S. Cl. ..... 271/186; 271/187; 271/225; 271/902

[58] Field of Search ..... 271/65, 902, 213, 225, 271/184, 185, 186 I, 187

[56] References Cited

U.S. PATENT DOCUMENTS

| | | | |
|---|---|---|---|
| 3,862,802 | 1/1975 | Till | 355/23 |
| 3,908,981 | 9/1975 | Naroff | 271/275 X |
| 4,359,217 | 11/1982 | Roller et al. | 271/186 |
| 4,735,409 | 4/1988 | Brown | 271/186 |
| 5,090,680 | 2/1992 | Yashiro | 271/186 |

FOREIGN PATENT DOCUMENTS

| | | | |
|---|---|---|---|
| 0072562 | 5/1982 | Japan | 271/186 |

OTHER PUBLICATIONS

Jennings, Reversible Paper Feed, Feb. 1972, IBM Technical Disclosure Bulletin vol. 14 No. 9, p. 2790.

Jenkins, Sheet Flip Enhancer, Dec. 1980, IBM Technical Disclosure Bulletin vol. 23 No. 7A, pp. 2635–2636.

*Primary Examiner*—H. Grant Skaggs

*Assistant Examiner*—Carol Lynn Druzbick

[57] ABSTRACT

A low cost, compact inverter for reversing the lead and trail edges of a sheet. The inverter includes a reversible roller of about 2" in diameter onto which a sheet is scrolled and subsequently unscrolled, thereby reversing the lead and trail edges of the sheet.

12 Claims, 3 Drawing Sheets

COMPACT INVERTER

CROSS-REFERENCE TO RELATED APPLICATION

Copending and commonly assigned Application Ser. No. 08/251,144, entitled Low Cost Compact Inverter, by Chee-Chu J. Wong and Lisbeth S. Quesnel, field on May 31, 1994, is hereby cross-referenced.

BACKGROUND OF THE INVENTION

This invention relates to an improved sheet inverting system, and more particularly, to a low cost inverter adapted to be placed within the normal paper path of low volume copier/printer products while providing enhanced product design possibilities due to its compact configuration.

Although, a sheet inverter is referred to in the copier/printer art as an "inverter", its function is not necessarily to immediately turn the sheet over (i.e., exchange one face for the other). Its function is to effectively reverse the sheet orientation in its direction of motion. That is, to reverse the lead and trail edge orientation of the sheet. Typically, in inverters as disclosed here, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

In the field of reprographic machines, it is often necessary to feed along one of two alternate paths a copy sheet leaving the processor of the machine, particularly when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feed it back into the processor, but inverted, so that the appropriate data can be applied to the second side of the sheet. One known sheet-feeder (U.S. Pat. No. 4,359,217) for effecting this includes three rollers in frictional or geared contact with each other, to provide two spaced-apart nips, one being an input nip to an associated downstream sheet pocket, and the other being an output nip for extracting each sheet from the pocket. Another known sheet feeder (U.S. Pat. No. 4,735,409) includes four rollers and three spaced apart nips with one input up and two output nips. A sheet reversing apparatus for reorienting sheets so that a first side and an opposing side of the sheets may be operated upon is provided in U.S. Pat. No. 3,862,802 which includes a web for storing the sheets. These inverters have shortcomings when adaptation is attempted for insertion into low volume machines since they are costly, cumbersome and require more machine volume to implement than is desired. One of the reasons why the smallest, personal size copiers/printers do not print on both sides of a sheet is that the conventional inverting schemes would prohibitively enlarge the machine size. What has been mostly used are either flat trays or curved slots ("scorpion tail inverter") which require by their very nature certain minimum space.

The present invention aims at providing an inverter designed to have a sheet to be duplexed fed to it, stored momentarily, and wound to a much smaller diameter to save space. A roller pair is used to assist rolling and unrolling the sheet in order to prevent jamming one can expect at smaller radii of curvature.

SUMMARY OF THE INVENTION

Accordingly, the present invention provides a low cost, compact inverter configuration that enables duplex in low end, compact copier/printers. A slotted 2" diameter roll rotates within a cylindrical inverter chamber. The lead edge of a sheet enters a slot cut into the outer surface of the roll, whereupon the roll begins to rotate. The sheet is then loosely wrapped into a scroll within the chamber until its trail edges reaches an inversion point. The roll then reverses and unscrolls the sheet. This approach avoids generating excessive curl by use of a short dwell time and low sheet wrap tension while simultaneously enabling inversion for sheets of arbitrary lengths.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the low cost, compact inverter system for a copier/printer. However, it should be understood that the sheet inverting method and apparatus of the present invention could be used with any machine in which reversal or inversion of a sheet is desired.

In general, an improvement to prior sheet inverter systems of machines is disclosed which is cost effective and space efficient and comprises the use of a compact inverter that uses the existing paper path to invert a sheet.

Figure 1:
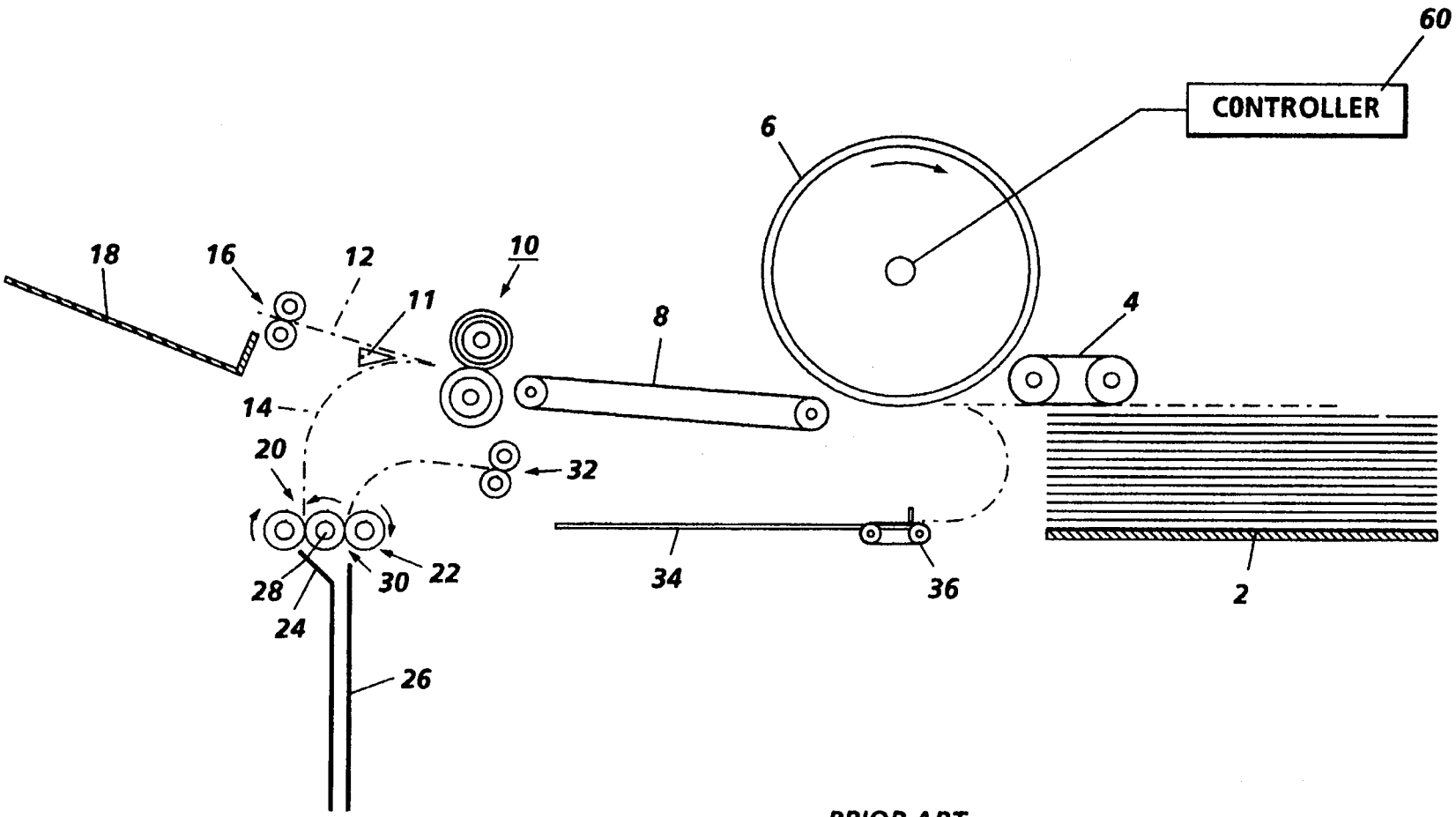
PRIOR ART FIG. 1
FIG. 1 is a schematic of a printing apparatus employing a conventional inverter.

The known apparatus shown in FIG. 1 consists basically of means for holding a stack 2 of copy sheets adjacent to a feeder 4 for extracting a sheet from the top of the stack each time a copy is required. Each sheet leaving feeder 4 passes in non-sliding contact with a photoreceptor 6 (shown here in the form of a drum, although it could equally be a belt), from which a particulate material (toner) designed to present a visual contrast with the material of the sheet is transferred from the surface of the photoreceptor to the upper face of the respective sheet. After the sheet with the toner image held on it by electrostatic attraction has been detached from the photoreceptor 6, it is conveyed by a conveyor 8 to a fuser 10, which fuses the toner into a permanent bond with the material forming the sheet, by the application of heat and/or pressure.

On leaving the fuser, the sheet contacts a diverter 11 which deflects the sheet so that it moves along one of two paths 12 and 14. Path 12 is an output path, which leads to a nip 16 ejecting each finished sheet into an output tray 18. A sheet deflected along path 14 passes to the input nip 20 of tri-roll inverter generally referenced 22. Downstream of nip 20 is an inclined surface 24 leading to a substantially-vertical pocket 26. Although not shown in FIG. 1, the bottom of the pocket has in it known means, such as an aligned series of O-rings, positioned at a distance from the inverter 22 such that when the lead edge of the sheet being fed by nip 20 comes into contact with the O-rings etc., the trail edge of the sheet leaves the nip 20. Because of the lateral displacement (as viewed) of the pocket from the nip 20, the sheet being fed into the pocket necessarily has a curve induced in it. The natural resilience of the sheet material is used to flip the freed trail edge of the sheet to the right as viewed, immediately it is clear of the nip 20. The sheet itself has sufficient momentum to deflect the reversing means sufficiently to permit the trail edge of the sheet to move below the bottom of the center roll 28. When the energy stored in the distorted reversing means is released, it is expended on reversing the direction of the momentum of the sheet, and force the former trail edge of the sheet to become a new lead edge, which is forced into the other nip 30 of the inverter 22. The nip thus functions to extract the sheet from the pocket 26, and pass it through a sheet transport nip 32 into a buffer tray 34, which is sometimes also known as a dedicated duplex tray. With orientation as viewed, it will be seen that the face of the sheet having the first copy applied to it will be uppermost in tray 34. Each sheet in tray 34 is engaged by a bottom mounted feeder 36 which is effective to extract the sheet from the tray 34 and turn it through a sufficient angle for its remaining blank side to come into contact with the photoreceptor 6, and for the process to be repeated. Matters are arranged that when the resultant duplex copy sheet leaves fuser 10, it is passed directly to output tray 18, without being redirected towards inverter 22.

Figure 2:
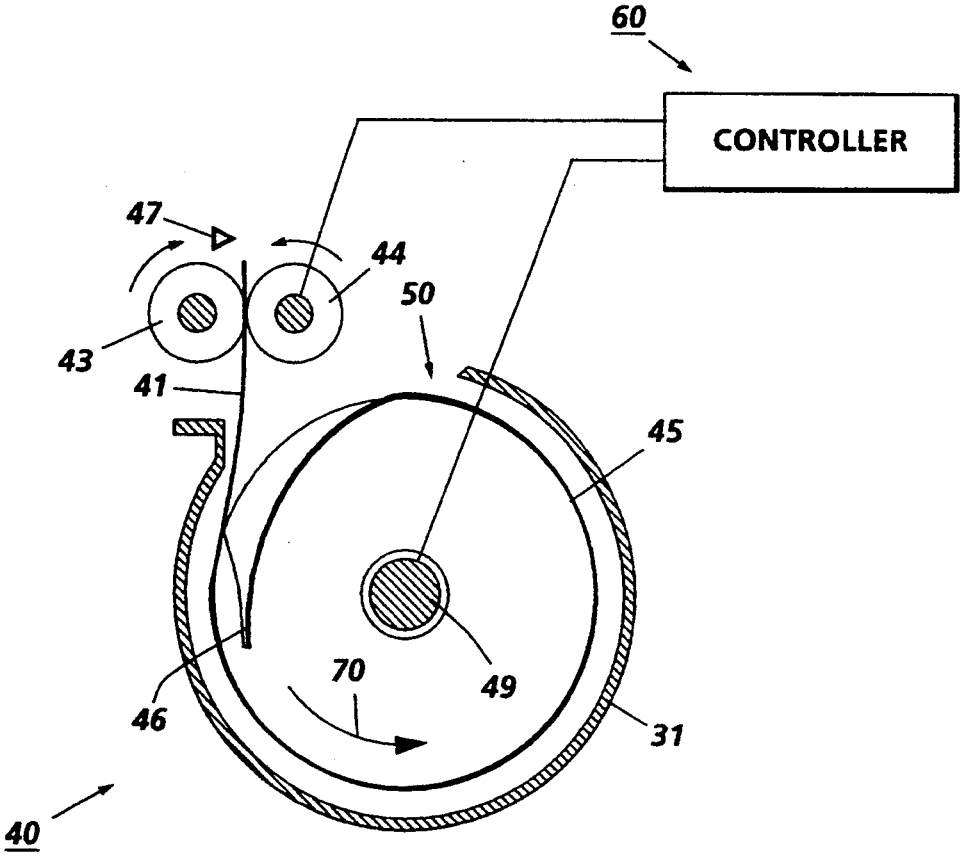
FIG. 2 is a schematic of the inverter in accordance with the present invention showing a sheet in the process of being inverted as it is coming into the inverter in a first direction.
Figure 3:
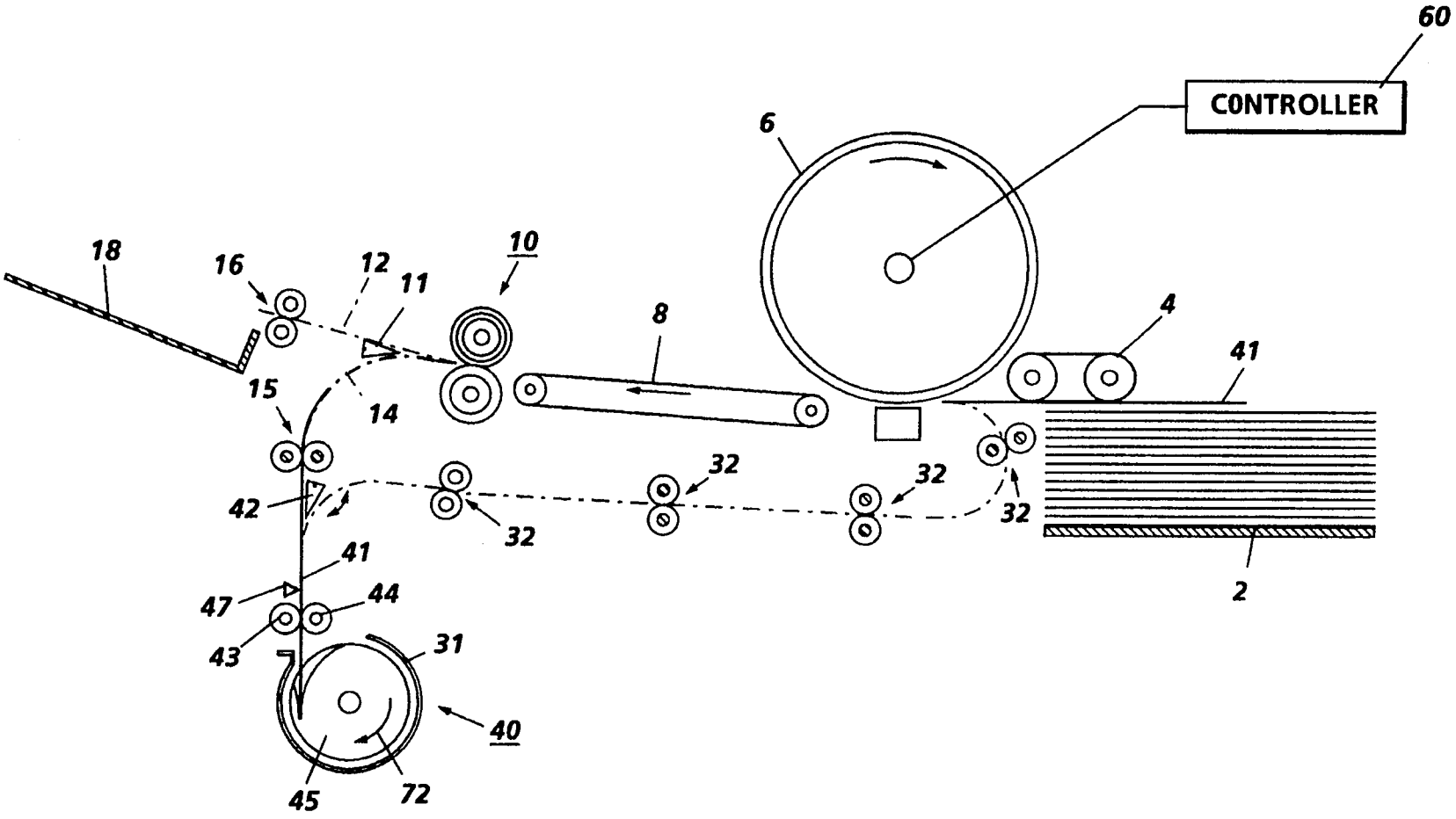
FIG. 3 is a schematic of the inverter of FIG. 2 showing the sheet after it has been inverted and being transported out of the inverter in a second and opposite direction to the first direction.

With the low cost, compact inverter 40 of the present invention, as shown in FIGS. 2 and 3, replacing the inverter 20 of FIG. 1, buffer tray 34 is preferably eliminated. To save space, copy sheet 41 is not fed into a flat tray or curved slot, but is wound onto a roller and then refed from this roller. What has been shown and described is called trayless duplex, but the sheets could all be deposited back into buffer tray 34, for subsequent feeding, if desired. Utilizing a 2" diameter roller, this "inverter tray" adds no more than about 2.5"×2.5" to the machine cross section. Inverter 40 comprises an idler roll 43 that forms a sheet driving nip with drive roll 44 with the nip receiving individual sheets fed thereinto from drive roller nip 15 of FIG. 3. A housing 31 has a reversible inverting roller 45 mounted on shaft 49 for rotation within the housing in the direction of arrow 70 of FIG. 2. A slot 46 is cut into the inverting roller 45 and in its initial or home position faces a nip formed between an idler roller 43 and a reversible roller 44 which drives a copy sheet into and out of the slot. A sheet trail edge sensor 47 is positioned downstream of fuser 10 and is connected to a controller 60 and adapted to give a signal to the controller 60 when the trail edge of copy sheet 41 is about to pass through rollers 43, 44 once duplex printing is selected by a machine operator. The controller 60 in turn, after a delay given by the machine timing cycle, actuates reversible drive roller 44 and reversible inverting roller 45 in the direction of arrow 72 of FIG. 3 with the sheet being directed by deflector 42 to feed transport rolls 32 that drive the sheet back to the photoreceptor for imaging on the opposite side thereof.

When the two-sided printing (copying) option is selected, a copy sheet 41 exiting the fuser is diverted towards the inverter housing 31. The sheet is advanced between the feed rollers 43 and 44 into the slot 46 of the roller 45. The roller 45 starts turning in the counterclockwise direction of arrow 70 just before the paper reaches the end of the slot 46. It will be appreciated that the timing of the roller motion is not critical in this particular embodiment. The roller 45 may start rotating when the leading edge of the paper is about ⅛" from the end of slot 46 in that the function of the roller is to guide the sheet around the small radius cavity without jamming. That is, the sheet 41 is not, and need not, be tightly wound around the roller as shown in FIG. 3. Feed rollers 43 and 44 and roller 45, connected to a conventional optical sensor 47 and machine controller 60, stop rotating when the trail edge of the sheet is about to pass through the nip formed between rollers 43 and 44. After a delay given by the printing machine timing cycle, the rollers 43, 44 and 45 start rotating in the opposite direction feeding the sheet 41 into the return path of sheet transport nips 32 and back to the photoreceptor 6 for the sheet to receive an image on its non-imaged side. When duplex copying is not required, sheet 41 passes directly into output tray 18 without being deflected into inverter 40.

The slotted roller 45 can be formed, for example, from a soft rubber 48 directly onto a steel shaft 49 as shown in FIGS. 2 and 3, or hard plastic, metal or it can comprise an array of slotted discs or other hollowed structure to reduce material amount and cost. However, other more sophisticated alternatives could be used, such as, built-in gripper fingers or a gripper bar activated by the contact of the lead edge of the sheet with the end of the slot 46 or by the sheet 41 contacting a sensing surface in position 50 when the roller 45 has advanced about 90° clockwise. While roller 45 has been disclosed as being about 2" in diameter, it is contemplated that further reductions in the diameter of the roller and housing 31 are possible since the storage of the sheet in the rolled position is only momentary or alternatively, the roller could be made larger, e.g. 10" in diameter. Additionally, inverter 40 is usable with web fed machines for duplexing purposes by feeding the web through the machine and recording all necessary images onto the web in a first pass past the imaging portion of the machine while simultaneously scrolling the web onto roller 45 creating a long scroll. Then, the end of the web is cut and the web is reversed back through the imaging portion of the machine to print onto the second side of the web.

In conclusion, a low cost, compact inverter has been disclosed that uses a small diameter reversible roller with a slot therein to wind a sheet thereupon and unwind the sheet therefrom while reversing the leading and trail edges of the sheet.

It is, therefore, evident that there has been provided in accordance with the present invention a a low cost, compact inverter that fully satisfying the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An inverter device, comprising:

a first reversible drive roller forming a nip with an idler roller for driving a sheet in either of two directions; and a second reversible roller, said second reversible roller having a slot therein adapted to receive a sheet fed thereinto by said first reversible drive roller, said second reversible roller being adapted to scroll a sheet captured in said slot onto its outer surface a predetermined amount and then unscroll the sheet, thereby inverting the sheet by exchanging the trail and lead edges of the sheet.

2. The inverter device of claim 1, including a controller for controlling the starting, stopping and direction of rotation of said first and second reversible rollers.

3. The inverter device of claim 1, including a sensor for sensing the trail edge of the incoming sheet and signaling said controller to stop rotation of said first and second reversible rollers.

4. The inverter device of claim 3, wherein said second reversible roller is formed from a soft rubber.

5. The inverter device of claim 3, wherein said second reversible roller is formed from plastic.

6. The inverter device of claim 3, wherein said controller actuates said second reversible roller before the sheet reaches an end portion of said slot.

7. A compact inverter for reversing the lead and trail edges of a sheet, including a reversible roller forming a nip with an idler roller and adapted to drive a sheet therethrough; and a reversible inverting roller, said reversible inverting roller having a slot therein that is adapted to receive the sheet from said reversible roller and scroll the sheet onto its outer surface and subsequently to unscroll the sheet back into said nip formed between said reversible roller and idler roller.

8. The compact inverter of claim 7, including a sensor for sensing the trail edge of the sheet as it is being scrolled onto said reversible inverting roller.

9. The compact inverter of claim 8, wherein said reversible inverting roller is about 2" in diameter.

10. A method for reversing the lead and trail edges of sheets, comprising the steps of:

providing a reversible roller forming a nip with an idler roller;

driving a sheet in a predetermined direction with said reversible roller; and receiving the sheet with a reversible inverting roller, said reversible inverting roller having a slot therein that is adapted to receive the sheet from said reversible roller and scroll the sheet onto its outer surface and subsequently to unscroll the sheet back into said nip formed between said reversible roller and idler roller.

11. The method of claim 10, including the step of controlling the rotary motion of said reversible roller and reversible inverting roller with a controller.

12. A compact inverter for individually reversing the lead and trail edges of a plurality of cut-sheets, including a reversible roller forming a nip with an idler roller and adapted to drive an individual sheet therethrough; and a reversible inverting roller, said reversible inverting roller having a slot therein that is adapted to receive the individual sheet from said reversible roller and scroll the sheet onto its outside surface and subsequently to unscroll the sheet back into said nip formed between said reversible roller and idler roller.

* * * * *